United States Patent [19]

Mastuyama et al.

[11] Patent Number: 4,530,591

[45] Date of Patent: Jul. 23, 1985

[54] ORIGINAL CONVEYING APPARATUS FOR COPYING MACHINE

[75] Inventors: Takashi Mastuyama, Hachioji; Kazuo Noda, Tokyo, both of Japan

[73] Assignee: Olympus Optical Company Ltd., Tokyo, Japan

[21] Appl. No.: 484,540

[22] Filed: Apr. 13, 1983

[30] Foreign Application Priority Data

Jun. 3, 1982 [JP] Japan ..... 57-94060

[51] Int. Cl.[3] ..... G03G 15/28

[52] U.S. Cl. ..... 355/8; 355/3 SH; 271/267

[58] Field of Search ..... 355/8, 50, 51, 3 SH, 355/14 SH; 271/267, 274, DIG. 9

[56] References Cited

U.S. PATENT DOCUMENTS

| | | | |
|---|---|---|---|
| 3,728,015 | 4/1973 | Opravil | 355/8 |
| 3,740,133 | 6/1973 | Komori et al. | 271/267 X |
| 3,790,272 | 2/1974 | Knechtel et al. | 355/8 X |
| 4,009,955 | 3/1977 | Komori et al. | 355/8 |
| 4,186,919 | 2/1980 | Miciukiewicz | 355/8 X |
| 4,188,028 | 2/1980 | Miciukiewicz | 271/267 X |

*Primary Examiner*—Richard L. Moses

*Attorney, Agent, or Firm*—Louis Weinstein

[57] ABSTRACT

An original conveying apparatus is provided for use in a copying machine having a moving original receptacle which permits a copying from either a sheet original or a thick material. A thick material receptacle is integrally formed with a sheet original drive. A sheet original is conveyed by the sheet original drive while the receptacle is maintained at its home position. A thick material is conveyed by a reciprocatory movement of the receptacle from its home position, without previously changing its position. The sheet original drive can be smoothly engaged with or disengaged from a transmission system.

11 Claims, 4 Drawing Figures

ORIGINAL CONVEYING APPARATUS FOR COPYING MACHINE

BACKGROUND OF THE INVENTION

The invention relates to an original conveying apparatus for copying machine, and more particularly, to such apparatus which may be used to convey an original in the form of either sheet or thick material for effecting an exposure process and including a thick material receptacle which integrally carries a sheet original drive.

An original from which a copy is to be produced in a copying machine may be a single sheet or a thick material such as book. In most copying machines of the prior art, an original which may be in the form of either sheet or thick material is placed on a common receptacle, formed by a transparent plate, and is held in place by an original retainer before the receptacle is driven toward an exposure position. In such an arrangement, the original receptacle undergoes a reciprocatory movement with respect to an exposure station defined by original scanning optics which is fixedly located within the copying machine. However, the original is scanned only during the forward stroke of the original receptacle, and hence the time required to complete its reverse or returning stroke is entirely wasteful, causing a reduction in the speed of copying operation.

While a copying machine is available which is originally designed for use with originals in the form of sheets alone, this type of copying machine must be modified to allow a copying operation of thick materials. However, a very complex operation is required when copying from a thick material.

To overcome these difficulties, various arrangements have been proposed. In one arrangement, there is provided a conveying unit associated with an original in the form of a sheet and which is separate from a conveying unit associated with a thick material. A movable mirror is disposed in an optical path which focusses an image so that the movement of the mirror is effective to establish selectively the optical paths which may be used with a single sheet or thick material. In another arrangement, means is provided which selectively couples drive means with either a sheet original conveying unit or a thick material receptacle which is integrally provided on the sheet conveying unit at a location adjacent thereto, thus permitting a copying operation from either sheet or thick material.

However, the former requires the provision of means which selectively changes the optical path for projection of an image while the latter involves a manual operation to move the thick material receptacle through a given distance from its home position to its start position in order to disengage the meshing engagement between a drive gear associated with a sheet original and another gear provided in the drive means mounted on the part of the copying machine whenever it is desired to copy from a thick material. In either instance, the operation is cumbersome.

SUMMARY OF THE INVENTION

It is an object of the invention to eliminate the described disadvantages of conventional copying machines in respect of original conveying apparatus, by providing an original conveying apparatus for a copying machine including a thick material receptacle which is integrally formed with a sheet original drive so that whenever copying from a sheet original is desired, the drive effects a conveying of the sheet original at a given position of the thick material receptacle, hereafter referred to as a home position, and whenever a copying from a thick material is desired, the receptacle is allowed to start its reciprocatory movement from the home position without previously changing its position.

The original conveying apparatus of the invention comprises a thick material receptacle, a sheet original drive which is integrally provided on the receptacle, and a drive system provided as part of the copying machine for transmitting driving power to the drive or alternatively for causing a reciprocatory movement of the receptacle. An original in the form of a sheet is conveyed with the original receptacle located at its home position while a thick material is conveyed by a reciprocatory movement of the receptacle from its home position without previously changing its position. In this manner, a cumbersome switching of the position of the receptacle which might otherwise be required between a copying from a sheet original and a copying from a thick material is avoided, allowing a rapid original conveying operation with a simple arrangement. Driving power is transmitted to the sheet original drive by a meshing engagement between a transmission gear of the sheet original drive and a drive gear of the drive system with a one-way clutch interposed therebetween. In this manner, the meshing engagement between the aforesaid gears can be automatically released or established in response to a reciprocatory movement of the receptacle. Accordingly, the reciprocatory movement of the receptacle from its home position is greatly facilitated.

DESCRIPTION OF PREFERRED EMBODIMENT

Figure 1:
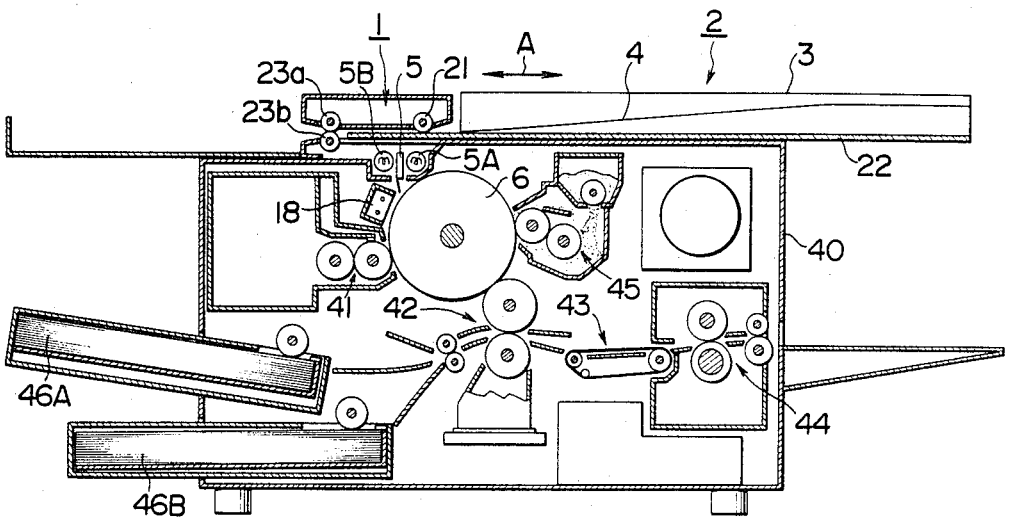
FIG. 1 is a schematic view of one form of copying machine in which an original conveying apparatus according to the invention is incorporated.
Figure 3:
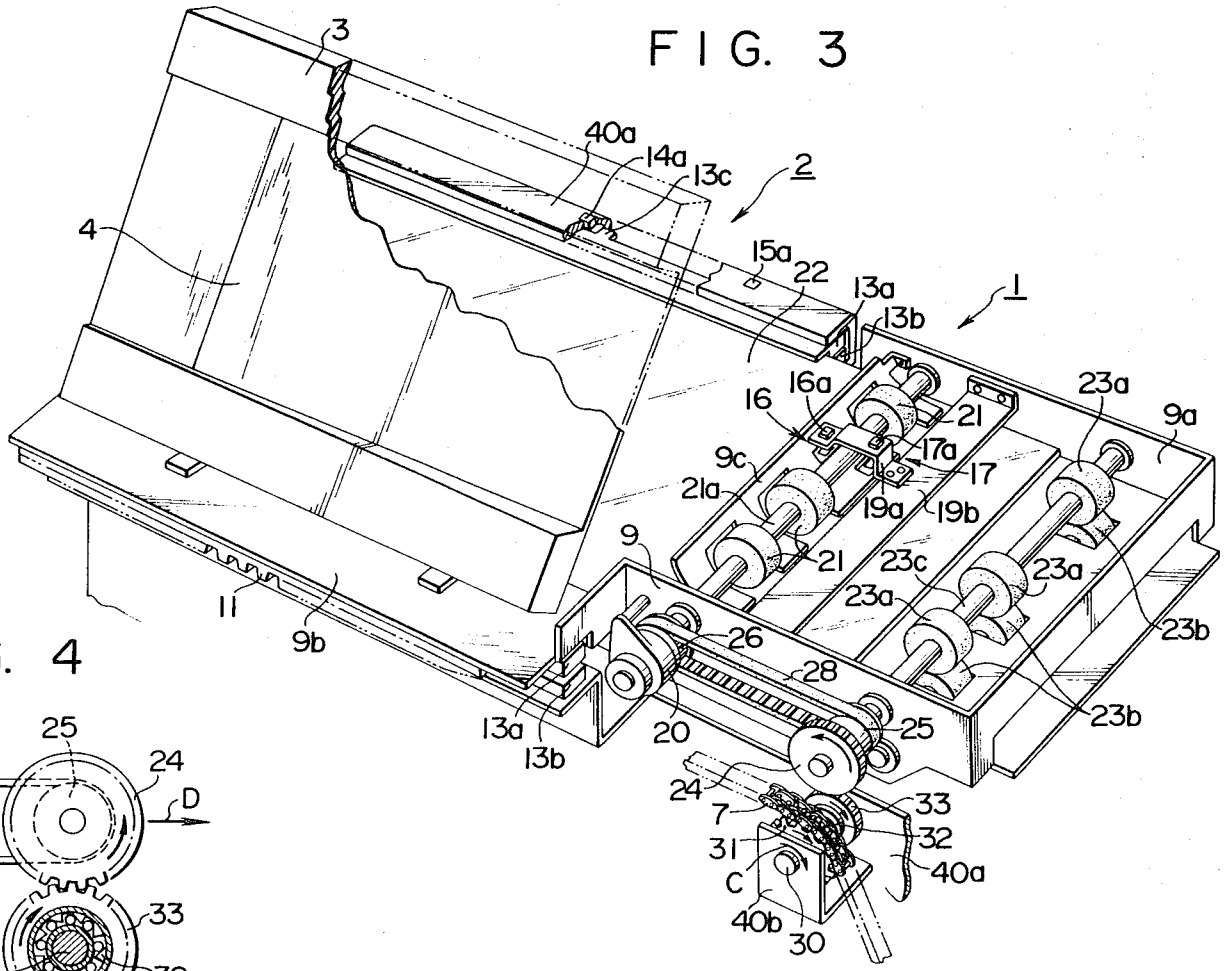

Referring to FIG. 1, there is shown an original conveying apparatus for a copying machine according to the invention. The apparatus comprises a thick material receptacle 2 which is disposed on a copying machine 40 in a movable manner, a sheet original drive 1 which is integrally associated with the receptacle 2, and a drive system disposed within the copying machine 40. Normally, the sheet original drive 1 is located immediately short of a position corresponding to an exposure window disposed above exposure optics 5, disposed within the top portion of the copying machine 40 and including a scanning lens or the like. As shown in FIG. 3, the receptacle 2 includes a stage glass 22 upon which a thick material such as book is placed, and the top surface of which is covered by a swingable original retainer plate 3. A platform 4 to receive a sheet original is defined on the top surface of the retainer plate 3, and is downwardly inclined toward the sheet original drive 1. When copying from a thick material, the sheet original drive 1 undergoes a reciprocatory movement together with the receptacle 2 in a direction indicated by a double arrow A shown in FIG. 1, by drive means to be described later.

The exposure optics 5 operates to form an image of an original, illuminated by lamps 5A, 5B, onto the surface of a photosensitive drum 6 in a well known manner, thus forming an electrostatic latent image thereon. Once the latent image is formed, it is developed by a developing unit 41, and the resulting visual image is transferred onto a copy sheet by a transfer unit 42, with the copy sheet being conveyed by a conveying unit 43 into a heat fixing unit 44 where the transferred image is fixed and the copy sheet is then delivered externally of the copying machine 40. Subsequent to the termination of the transfer step, the drum 6 is cleaned by a cleaning unit 45. The copying machine 40 is adapted to allow sheet cassettes 46A, 46B to be mounted therein which contain copy sheets of different sizes.

The detail of a copying process other than the exposure which takes place within the copying machine has no direct bearing with the present invention, and therefore will not be described.

Figure 2:
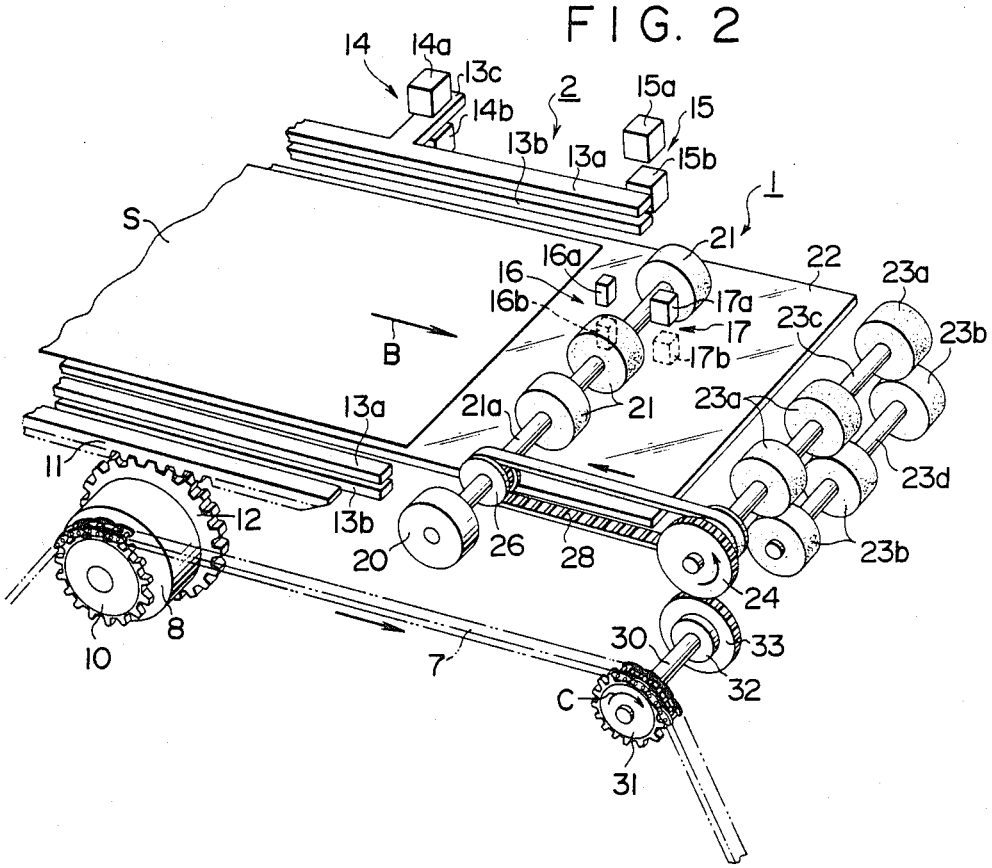
FIGS. 2 and 3 are perspective views of the original conveying apparatus, with a support frame for a stage glass on which to carry an original being removed in FIG. 2 to show essential parts.

FIGS. 2 and 3 are perspective views of the original conveying apparatus according to the invention, as viewed from the side which is opposite from the operating side. The receptacle 2 is driven for reciprocatory movement by a reciprocatory mechanism, to which driving power is transmitted through a first drive system. The apparatus also includes a second drive system which transmits driving power to the sheet original drive 1 through a one-way drive mechanism.

As shown in FIGS. 2 and 3, the receptacle 2 comprises the transparent stage glass 22 on which a thick material is placed, a support frame 9 which supports the stage glass 22 and is adapted to reciprocate across the exposure window over the copying machine 40, a pair of guide rails 13*a* fixed to the opposite sides of the frame 9 in parallel relationship with a direction along which the receptacle 2 moves, the sheet original drive 1 mounted on a front portion 9*a* of the frame 9, and the original retainer plate 3 which is mounted along one lateral edge 9*b* of the frame 9 at its one end so as to be swingable with respect to the top surface of the stage glass 22 to urge a thick material placed thereon against the glass surface.

The guide rails 13*a* are located immediately above stationary guide rails 13*b* which are fixedly mounted in a frame 40*a* of the copying machine 40, and the cooperation between the guide rails 13*a*, 13*b* is effective to guide a reciprocatory movement of the receptacle 2. One of the upper guide rails 13*a* which are secured to the support frame 9 is formed with a projection 13*c* along its lateral edge which is effective to operate a sensor. The purpose of the projection 13*c* is to define a home position for the receptacle 2. If it is assumed that the home position of the receptacle 2 is the position shown in FIG. 1, for example, an optical sensor 14 detects such location of the projection 13*c* and produces an output which is effective to actuate a braking unit, not shown, to maintain the receptacle 2 at rest at such location where the projection 13*c* is detected. Specifically, the sensor 14 comprises a light emitting element 14*a* and a light receiving element 14*b* which are located in vertically opposing relationship with each other on the opposite sides of the projection 13*c*, thus forming a photo-coupler. The elements 14*a*, 14*b* are mounted on the stationary frame 40*a* within the copying machine 40. The projection 13*c* is also operative to actuate another optical sensor 15 which is provided for aligning purposes. Specifically, the sensor 15 also comprises a photo-coupler including light emitting element 15*a* and light receiving element 15*b* disposed in vertical alignment with each other and across the path of movement of the projection 13*c*. The sensor 15 is also mounted on the stationary frame 40*a*, at a location forwardly of the sensor 14. The sensor 15 operates to detect the front end of a thick material placed on the stage glass 22 to produce a signal which adjusts the timing of operation with respect to the operation of a charger 18 (see FIG. 1) which charges a photoconductive layer of the drum surface. When the sensor 15 detects the projection 13*c*, the movement of the receptacle 2 is once stopped in response thereto, and the movement is re-initiated in synchronism with the initiation of the charging operation.

As shown in FIG. 3, the reciprocatory mechanism associated with the receptacle 2 includes a rack 11 which is fixedly mounted along one edge of the support frame 9, and a pinion 12 (see FIG. 2) disposed in meshing engagement with the rack 11 and adapted to be driven in either forward or reverse direction by the first drive system. The pinion 12 and the first drive system are disposed within the stationary frame 40*a*, and the first drive system is driven by a drive source, not shown, disposed within the copying machine 40. Referring to FIG. 2, the first drive system comprises a drive chain 7, a sprocket 10 rotatably mounted on the stationary frame 40*a* and driven by the chain 7 for rotation, and a reversible clutch 8 interposed between the sprocket 10 and the pinion 12 and selectively assuming an operative condition in which it transmits the drive from the sprocket 10 during its forward and reverse rotation to the pinion 12 and an inoperative condition in which it does not transmit the drive from the sprocket 10 to the pinion 12, thus maintaining the latter in its neutral condition.

Referring to FIGS. 2 and 3, the sheet original drive comprises drive rollers 21 rotatably mounted in the front frame portion 9*a* and disposed so that their peripheral surface bears against the upper surface of the stage glass 22, and a transmission gear 24 rotatably carried by the front frame portion 9*a* on the outside thereof for transmitting driving power to the drive rollers 21 through a clutch 20. It will be seen that the drive rollers 21 have a reduced axial length and are fixedly mounted on a drive shaft 21*a* which is in turn rotatably mounted in the front frame portion 9*a* and extending transversely thereacross. The peripheral surface of each roller bears against the upper surface of the stage glass 22 which extends toward the front end of the frame portion 9*a*. In the home position of the receptacle 2, the front portion of the stage glass 22 which extends forwardly of the drive rollers 21 is aligned with the exposure window within the copying machine 40. Accordingly, a sheet original inserted between the drive rollers 21 and the stage glass 22 is fed toward a position which is located over the exposure window as the drive rollers 21 rotate. A curved guide 9*c* has its opposite ends secured to the front frame portion 9*a*, on the left-hand side, as viewed in FIG. 3, of the drive rollers 21 for guiding a sheet original between the drive rollers 21 and the stage glass 22. The clutch 20 is coaxially mounted on one end of the drive shaft 21*a* which extends through one of side walls of the front frame portion 9*a*.

Pairs of vertically aligned conveying rollers 23*a*, 23*b* are disposed on the front frame portion 9*a* toward the front end thereof for conveying a sheet material further forwardly as it is conveyed by the drive rollers 21. Each of these rollers has a reduced axial length and is fixedly mounted on support shaft 23*c* or 23*d*, respectively, which is in turn rotatably mounted on the front frame portion 9*a* and extending thereacross. The upper shaft 23*c* extends through one of side walls of the frame portion 9*a*, with the transmission gear 24 fixedly mounted on the end thereof. Accordingly, the upper rollers 23*a* which are driven by the gear 24 represent drive rollers while lower rollers 23*b* represent follower rollers. A belt pulley 24 is fixedly mounted on the end of the shaft 23*c* which projects through the side wall of the frame portion 9*a*, and a timing belt 28, formed by a toothed, endless belt, extends around the pulley 24 and another belt pulley 26 which is fixedly mounted on the end of the drive shaft 21*a* on which the clutch 20 is mounted. Accordingly, driving power is transmitted to the drive shaft 21*a* from the transmission gear 24 through the timing belt 28, with such transmission being turned on or off by the clutch 20.

The sheet original drive 1 also includes a pair of optical sensors 16 and 17, which are provided for the detection of an original and for alignment purpose, respectively. Each of these sensors is formed by a photo-coupler including a light emitting and a light receiving element. Specifically, the sensor 16 includes light emitting element 16*a* which is mounted on a mounting member 19*a* at a location short of and adjacent to the drive rollers 21, and also includes light receiving element 16*b* which is fixedly disposed below the stage glass 22 in alignment with the element 16*a*. When a sheet original S is inserted in a direction indicated by an arrow B, as indicated in FIG. 2, the sensor 16 detects the lleading end of the original S, and actuates the clutch 20 in the sheet original drive 1 to transmit a driving power to the drive shaft 21*a*. The sensor 17 includes light emitting element 17*a* which is mounted on the mounting member 19*a* on the opposite side of the drive rollers from the sensor 16, and also includes light receiving element 17*b* which is fixedly disposed below the stage glass 22 in alignment with the element 17*a*. It is to be noted that the mounting member 19*a* is secured to a bar 19*b* extending across the front frame portion 9*a*. The sensor 17 detects a sheet original S as it is conveyed by the drive rollers 21, and produces an output signal which deactuates the clutch 20 to interrupt the rotation of the drive rollers 21, thus momentarily stopping the conveying operation of the sheet original S. The rotation of the drive rollers 21 is initiated again in synchronism with the initiation of the operation of the charger 18 to charge the photosensitive drum 16.

Figure 4:
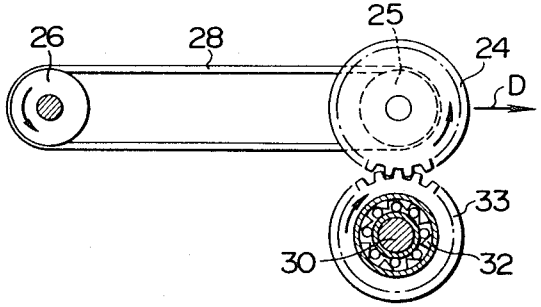
FIG. 4 is a side elevation of one-way drive mechanism which transmits a driving power to a sheet original drive.

One-way drive mechanism which causes the drive rollers 21 and the conveying rollers 23*a*, 23*b* to rotate in one direction comprises the transmission gear 24, and a drive gear 33 which is mounted on the stationary frame 40*a* and meshes with the gear 24. The gear 33 is driven for rotation by the second drive system through one-way clutch 32. The one-way drive mechanism and the second drive system are constructed as illustrated in FIGS. 3 and 4. Specifically, the second drive system includes a sprocket 31 fixedly mounted on a rotary shaft 30 which is rotatably mounted in a support plate 40*b* by means of a suitable bearing. The support plate 40*b* is integrally secured to the stationary frame 40*a* and is L-shaped in section. The drive chain 7 extends around the sprocket 31. The drive gear 33 in which the one-way clutch 32 is a press fit is mounted on the end of the rotary shaft 30.

The construction of one-way clutch 32 is conventional, and it operates to transmit a drive from the rotary shaft 30 to the drive gear 33 only when the shaft 30 is driven to rotate clockwise or in a direction indicated by an arrow C, by means of the drive chain 7 and the sprocket 31, thus causing the gear 33 to rotate clockwise and causing the transmission gear 24 to rotate counter-clockwise. However, when the rotary shaft 30 rotates in the counter-clockwise direction or in the opposite direction from the arrow C, the drive therefrom is not transmitted to the drive gear 33, thus allowing the shaft 30 to idle.

It is to be understood that a stop device (not shown) within the copying machine 40 normally maintains the receptacle 2 at its home position in a stable manner.

In operation, when copying from a sheet original, the sheet original S is placed on the platform 4, and is manually fed in the direction of the arrow B as shown in FIG. 2. The sensor 16 then detects the original and actuates the clutch 20, whereupon the drive rollers 21 in the sheet original drive 1 are set in motion. Accordingly, the sheet original S is automatically conveyed toward the exposure window by means of the drive rollers 21. When the sensor 17 detects the sheet original S subsequently, the clutch 20 is deactuated to interrupt the rotation of the drive rollers 21, thereby temporarily stopping the conveying operation of the sheet original S. At the timing when the photoconductive layer of the drum surface is charged by the charger 18, the clutch 20 is actuated again, re-initiating the conveying operation of the sheet original S. As the sheet original S moves past the exposure window, the exposure optics 5 located below the window performs an exposure operation. Subsequent to the exposure step, the sheet original S is delivered externally of the sheet original drive 1 by means of conveying rollers 23*a* which rotate in the same direction as the drive rollers 21, as well as their associated follower rollers 23*b*. It will thus be seen that when copying from a sheet original, only the sheet original drive 1 operates to feed the sheet original S automatically toward the exposure window while the receptacle 2 is maintained at rest at its home position by a stop device, not shown.

Alternatively, when copying from a thick material, the retainer plate 3 is opened as indicated in FIG. 3, and an original in the form of a thick material is placed at a given position on the stage glass 22, and the retainer plate 3 is thereafter closed. By depressing a copying start switch, not shown, the stop device which maintains the receptacle 2 at the home position is released, thus releasing the receptacle 2 for free movement. With a given time delay, the reversible clutch 8 is actuated in the direction of the forward rotation, whereupon driving power from the first drive system is transmitted through the drive chain 7 to the rack 11, thus initiating the reciprocatory movement of the receptacle 2 from its home position for performing a copying operation from a thick material. At this time, the sheet original drive 1 also undergoes a reciprocatory movement in integral manner with the receptacle 2.

When the operation of the receptacle 2 is initiated, the transmission gear 24 which is effective to activate the sheet original drive 1 is in meshing engagement with the drive gear 33 which is driven by the second drive system provided on the part of the copying machine. However, the gear 33 internally houses the one-way clutch 32, which allows the gear 33 to rotate freely in a direction in which the gear 24 rotates during the forward stroke of the receptacle 2 (or in a direction indicated by an arrow D in FIG. 4 and causing the gear 33 to rotate clockwise). Thus, the gears 24 and 33 are disengaged automatically and smoothly as the forward stroke of movement of the receptacle 2 is initiated.

After the sheet original drive 1 is uncoupled from the drive system within the copying machine, both the sheet original drive 1 and the receptacle 2 continue to move through its forward stroke until the sensor 15 detects the projection 13*c* on the upper guide rail 13*a* which is fixedly mounted on the receptacle 2. Thereupon, the movement of the forward stroke is temporarily stopped, thus waiting for the initiation of a charging operation. When the charger 18 begins to charge the photoconductive layer of the drum surface, the movement of the receptacle 2 through its forward stroke is resumed to perform an exposure process with respect to the thick material, whereafter the forward stroke of the drive 1 and the receptacle 2 is terminated. Simultaneously with the termination of the forward stroke, the reversible clutch 8 is changed from the forward to the reverse rotation, thus initiating a reverse stroke. At the end of the reverse stroke, a smooth meshing engagement between the gears 24 and 33 is enabled since the gear 24 remains at rest. Also, at the end of the reverse stroke, the sensor 14 detects the projection 13*c*, and de-actuates the reversible clutch 8, allowing the stop device to maintain the receptacle 2 at its home position.

What is claimed is:

1. An original conveying apparatus for a copying machine, comprising:

a receptacle for placing an original in the form of a thick material thereon, the receptacle being normally maintained at its home position and adapted to be driven by a reciprocatory mechanism to undergo a reciprocatory movement along a linear path with a thick material placed thereon for effecting an exposure process whenever a copying from the thick material is desired;

a first drive system disposed with the copying machine for transmitting driving power to the reciprocatory mechanism when copying from a thick material;

a sheet original drive formed integrally with the receptacle and adapted to be driven by a second drive system disposed within the copying machine to convey an original in the form of a sheet for effecting an exposure process whenever it is desired to produce a copy from a sheet original;

and means coupled between the first drive means and the reciprocatory mechanism for selectively deactuating the reciprocatory mechanism associated with the receptable while enabling the first drive means to transmit a driving power to the sheet original drive through the second drive means and a one-way drive mechanism when copying from a sheet original, a conveying of the sheet original by the sheet original drive occurring with the receptacle maintained at its home position, and a conveying of the thick material being achieved by a reciprocatory movement of the receptacle starting from the home position.

2. An original conveying apparatus according to claim 1 in which the receptacle comprises a transparent stage glass on which an original in the form of a thick material is placed, a movable original retainer plate for retaining a thick material placed on the stage glass and beneath the retainer plate, a support frame for supporting the stage glass, the sheet original drive being mounted on the support frame, and a guide rail formed on the support frame.

3. An original conveying apparatus according to claim 1 in which the reciprocatory mechanism comprises a rack fixedly mounted on the receptacle, and a pinion disposed in meshing engagement with the rack and driven by the first drive system for reversible rotation.

4. An original conveying apparatus according to claim 1, further including a sensor disposed within the copying machine for detecting the home position of the receptacle.

5. An original conveying apparatus according to claim 4 in which the sensor comprises a photo-coupler including a light emitting element and a light receiving element and operable to detect a projection on a guide rail which is secured to the receptacle.

6. An original conveying apparatus according to claim 1 in which the first drive system is disposed within the copying machine, and comprises a drive chain, a sprocket driven by the chain for rotation, and a reversible clutch interposed between the sprocket and a pinion of the reciprocatory mechanism and capable of assuming a forward rotation, a neutral and a reverse rotation position.

7. An original conveying apparatus according to claim 2 in which the sheet original drive comprises a drive roller disposed to bear against a stage glass of the receptacle and adapted to convey a sheet original through its rotation in one direction, and a transmission gear for transmitting driving power to the drive roller through a clutch.

8. An original conveying apparatus according to claim 7 in which the driving power to the drive roller is transmitted from the transmission gear as the latter rotates, through a toothed timing belt and a gear which is driven for rotation by the belt.

9. An original conveying apparatus according to claim 7 in which the sheet original drive further includes a conveying roller which is driven for rotation by the transmission gear for further conveying the sheet original after the latter has been conveyed by the drive roller.

10. An original conveying apparatus according to claim 1 in which the one-way drive mechanism comprises a transmission gear rotatably mounted on the receptacle, and a drive gear disposed in meshing engagement with the transmission gear and driven for rotation by the second drive system through a one-way clutch, the meshing engagement between the transmission gear and the drive gear being released at an early stage of the forward stroke portion of the reciprocatory movement of the receptacle and smoothly re-established toward the end of the reverse stroke portion of the reciprocatory movement of the receptacle.

11. An original conveying apparatus according to claim 1 in which the first drive system comprises a drive chain, and the second drive system comprises a sprocket driven for rotation by the drive chain, and a one-way clutch interposed between the sprocket and a drive gear of the one-way drive mechanism.

* * * * *

UNITED STATES PATENT AND TRADEMARK OFFICE

CERTIFICATE OF CORRECTION

PATENT NO. : 4,530,591

DATED : July 23, 1985

INVENTOR(S) : Mastuyama et al

It is certified that error appears in the above-identified patent and that said Letters Patent is hereby corrected as shown below:

Column 1, line 42 after "selectively" insert --one of--.

Column 1, line 43 after "with" insert --either--.

Column 5, line 12 change "24" to --25--.

Column 5, line 15 change "24" to --25--.

Column 5, line 34 change "lIeading" to --leading--.

Signed and Sealed this

*Twenty-fifth* Day of *February 1986*

[SEAL]

*Attest:*

DONALD J. QUIGG

*Attesting Officer* *Commissioner of Patents and Trademarks*